US005754994A

United States Patent [19]

Soper

[11] Patent Number: 5,754,994

[45] Date of Patent: May 26, 1998

[54] SECONDARY LOCKING SYSTEM FOR DROP SIDE CRIBS

[76] Inventor: Michael Taylor Soper, 216 11th St., Pasadena, Md. 21122

[21] Appl. No.: 656,982

[22] Filed: Jun. 6, 1996

[51] Int. Cl.[6] ..... A47D 7/02

[52] U.S. Cl. ..... 5/100

[58] Field of Search ..... 5/100, 93.1, 424, 5/425

[56] References Cited

U.S. PATENT DOCUMENTS 4,724,556 2/1988 Burnham ..... 5/100

5,214,808 6/1993 Schoonover et al. ..... 5/100

*Primary Examiner*—Alexander Grosz

[57] ABSTRACT

A secondary locking system for the drop side of a crib comprises an elongated three sided channel bracket having first and second parallel sides with a third side perpendicular to said first and second sides, said third side having a mounting slot by which said bracket can be mounted to a crib leg so that the drop side can be raised and lowered within the bracket. The first and second sides have at least a pair of horizontally aligned opposed holes, and a slidable locking pin adapted to be removably passed through said opposed holes, whereby when the locking pin is passed through said opposed holes the locking pin prevents the raising or lowering of the drop side, and when the locking pin is removed from said opposed holes, the drop side can be raised and lowered.

1 Claim, 3 Drawing Sheets

1
2
15
4
11
5
6
7
3
11
5
9
8
4
2
10
1
14

SECONDARY LOCKING SYSTEM FOR DROP SIDE CRIBS

FIELD OF THE INVENTION

The crib boot is a secondary locking system for drop side cribs, yet will not interfere with the manufacturer's crib side locks already existing on the cribs.

BACKGROUND OF THE INVENTION

Drop side crib locks and fasteners should always be sound and sturdy. Anyone placing an infant in a crib should feel 100% assured the locking system on the crib will not fail, especially if the child is left unattended to sleep. Through normal everyday use, the wear on these locks may lessen the ability for a crib drop side to stay locked. Since infants are involved, extra safety precautions must be taken to ensure that the drop side remains locked in its raised position. These locks should also be extremely difficult for a child to operate, though easily operative for the guardian to maneuver. This present invention is a secondary locking device so that once the crib side is raised and locked by the crib boot and the manufacturer's locking system, the crib side cannot drop even if the manufacturer's locking system fails. The crib boot is very effective in establishing a locking engagement between the drop side and the crib leg. This is a universal lock for all corner drop rod cribs. The crib boot is mounted by using existing bolt holes in the crib leg and is easy to use and install, yet is still out of the reach of children. The crib boot will prevent many accidents and save children's lives.

This invention was construed due to an incident that occurred with my child. I walked into my daughter's bedroom one morning as she was pulling herself up to a standing position by the crib drop side of her new crib. I was standing in front of her when the crib drop side she was holding on to slammed down. The weight of the crib drop side and gravity drew her violently from the crib and cast her head first at the floor. This happened so fast, I don't know how I latched on to her feet with her head inches from the floor. What would have happened if she had awakened in the middle of the night and I wasn't there? Since this terrifying incident, I've been using the crib boot and I am 100% sure this event will not occur again.

SUMMARY OF INVENTION

The invention is called a crib boot and is a means for securing a crib drop side in its upright position. More specifically, the crib boot is comprised of a sixteen gauge steel bracket, a removable cylindrical steel pin, and a short length of braided wire connecting the two. The bracket is attached to a leg of the crib with several bolts set into the leg through a mounting slot on the back of the bracket. The two sides of the bracket have six holes drilled through them. When the crib drop side is in the raised position, the pin is inserted in the appropriate bracket holes, such that the pin is just below the bottom of the crib drop side. The crib boot acts as a secondary locking system for the drop side of a crib and comprises an elongated three sided channel bracket having first and second parallel sides with a third side perpendicular to said first and second sides, said third side having a mounting slot by which said bracket can be mounted to a crib leg so that the drop side can be raised and lowered within the bracket. The first and second sides have at least a pair of horizontally aligned opposed holes, and a slidable locking pin adapted to be removably passed through said opposed holes, whereby when the locking pin is passed through said opposed holes the locking pin prevents the raising or lowering of the drop side, and when the locking pin is removed from said opposed holes, the drop side can be raised and lowered.

LIST OF REFERENCE NUMERALS

1=CRIB LEG
2=DROP SIDE ROD
3=CRIB DROP SIDE
4=BRACKET
5=LOCKING HOLES
6=CONNECTING HOLE
7=BRAIDED WIRE LOOP
8=CRIMP ON CONNECTOR
9=BRAIDED WIRE
10=LOCKING PIN
11=MOUNTING BOLT
12=MOUNTING SLOT
14=PRESSED IN BEARING
15=DIRECTIONAL ARROW

MAIN EMBODIMENT OF THE INVENTION

Figure 1:
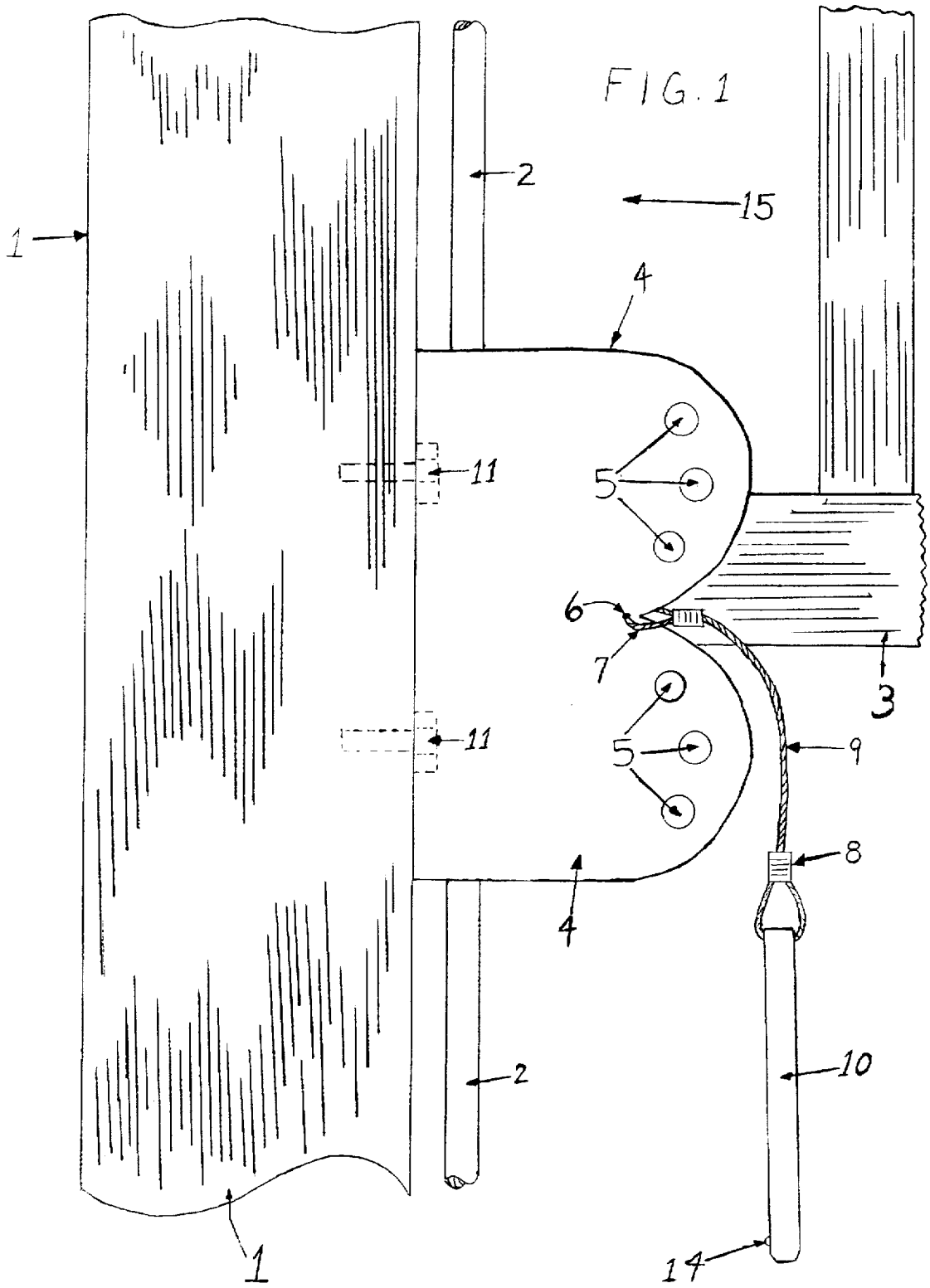
FIG. 1 is a side elevational view of the left hand side of a crib drop side with unlocked mounted crib boot.
Figure 2:
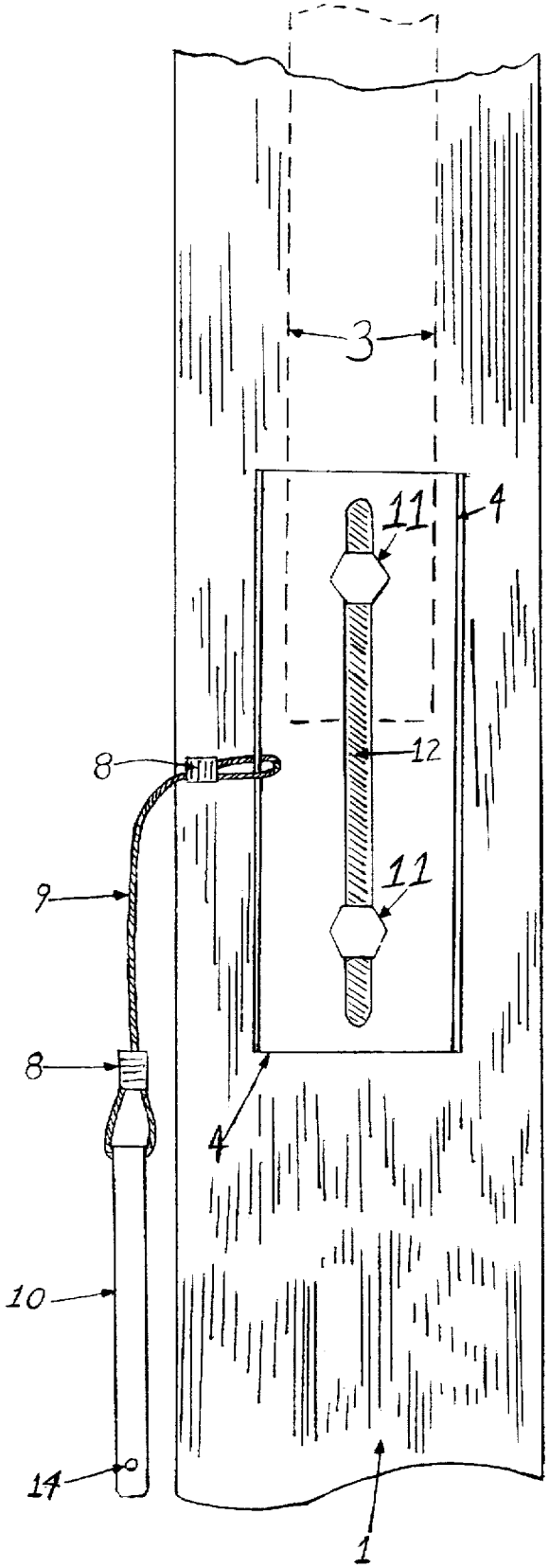
FIG. 2 is a front elevational view of the crib boot looking in the direction of arrow 15 in FIG. 1.
Figure 3:
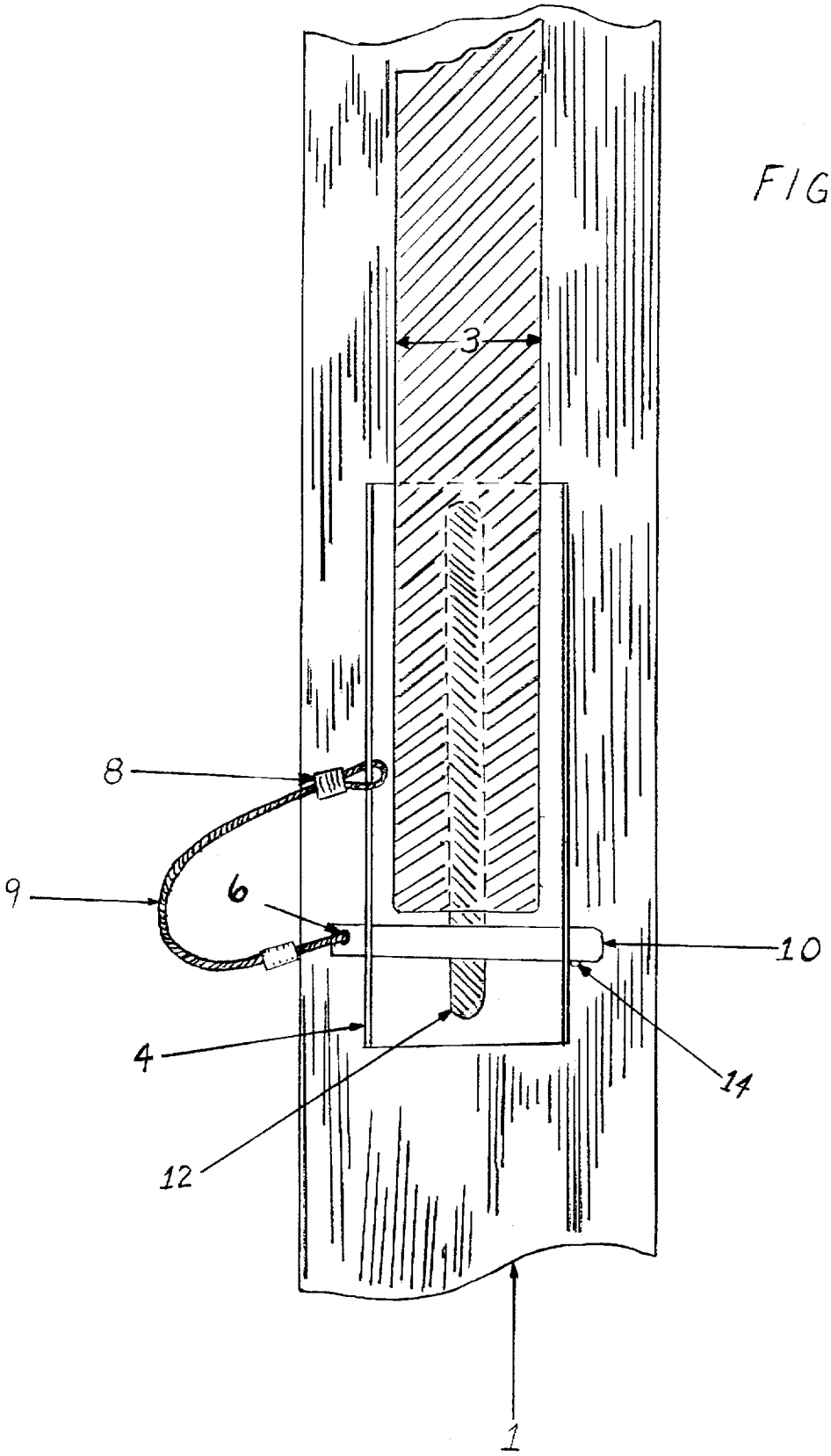
FIG. 3 is a front elevational view of the crib boot locking in the direction of arrow 15 in FIG. 1.

Conventional crib construction is well known. The entire crib has not been shown for a better understanding of the invention. FIG. 1 there are four crib legs 1 on a crib with a drop rod 2 fastened to each crib leg 1. The crib drop side 3 slides up and down the drop rod 2. The bracket 4 is fastened by several bolts 11 to the crib leg 1. FIG. 3 the bracket 4 is one piece and is bent into a three sided channel bracket having first and second parallel sides, with a third side perpendicular to said first and second sides, such that when the drop side 3 is up, or down, the bracket 4 will straddle the drop side 3. FIG. 1 the bracket 4 has six locking holes 5 drilled through the two sides to accommodate the locking pin 10 passing through them. The bracket 4 has a connecting hole 6 as does the locking pin 10. The connecting holes 6 are there to receive the braided wire 9 which is looped 7 through the bracket 4 and the locking pin 10 and is connected to itself by a crimp on connector 8 at both ends of the braided wire 9. FIG. 2 when the locking pin 10 is out of the locking holes 5 (locking holes 5 are best illustrated on FIG. 1) the crib boot is unlocked and the crib drop side 3 may pass through the bracket 4. FIG. 3 when the crib drop side 3 is in the raised position and the locking pin 10 is inserted into the appropriate locking holes 5 (just under the bottom of the crib drop side 3) then the crib boot is locked. The locking pin 10 has a pressed in bearing 14 in it to ensure the locking pin 10 remains engaged due to shaking and moving of the crib. The locking pin 10 must be physically pulled out to unlock the crib boot. Therefore, the locking pin 10 must be physically inserted to engage the crib boot in the locked position. FIG. 2 adjustments in the bracket 4 are made by using the mounting slot 12 located on the back edge of the bracket 4. The mounting bolts 11 are fastened into the crib legs 1 existing holes.

I claim:

1. In a crib comprising a plurality of legs, with at least one drop side adapted to be raised and lowered between two of said legs, the improvement comprising a secondary locking system for said drop side comprising an elongated three sided channel bracket having first and second parallel sides with a third side perpendicular to said first and second sides, said third side having a mounting slot by which said bracket can be mounted to a crib leg so that the drop side can be raised and lowered within the bracket, the first and second sides having at least a pair of horizontally aligned opposed holes, a slidable locking pin adapted to be removably passed through said opposed holes, whereby when the locking pin is passed through said opposed holes the locking pin prevents the raising or lowering of the drop side, and when the locking pin is removed from said opposed holes, the drop side can be raised and lowered.

* * * * *